US006652620B2

(12) United States Patent
Miyagawa et al.

(10) Patent No.: US 6,652,620 B2
(45) Date of Patent: Nov. 25, 2003

(54) METHOD FOR MANUFACTURING REDUCED IRON BRIQUETTES

(75) Inventors: Yoshiyuki Miyagawa, Tokyo (JP); Katsuhiro Tanaka, Tokyo (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 10/179,988

(22) Filed: Jun. 26, 2002

(65) Prior Publication Data

US 2003/0019548 A1 Jan. 30, 2003

(30) Foreign Application Priority Data

Jul. 10, 2001 (JP) ..... 2001-209313

(51) Int. Cl.[7] ..... C22B 15/00
(52) U.S. Cl. ..... 75/430
(58) Field of Search ..... 75/430, 433, 436, 75/484

(56) References Cited

U.S. PATENT DOCUMENTS 5,930,579 A * 7/1999 Nagumo et al. ..... 419/2
6,048,381 A * 4/2000 Kepplinger et al. ..... 75/436

FOREIGN PATENT DOCUMENTS

JP 6-316718 11/1994

* cited by examiner

*Primary Examiner*—Melvyn Andrews
(74) *Attorney, Agent, or Firm*—Oblon, Spivak, McClelland, Maier & Neustadt, P.C.

(57) ABSTRACT

A method for cooling hot reduced iron briquettes at low cost without degrading the strength is provided. The method includes a primary cooling step of cooling the hot reduced iron briquettes by steam at a cooling rate of 4.0° C./s or less, a secondary cooling step of cooling the reduced iron briquettes by steam and sprayed water at a cooling rate of 4.0° C./s or less, and a final cooling step of cooling the reduced iron briquettes by sprayed water at a cooling rate of 3.5° C./s or more to a temperature in a final product temperature range. The steam generated by evaporation of sprayed water during the final cooling step is used in the primary and/or secondary cooling step.

7 Claims, 5 Drawing Sheets

METHOD FOR MANUFACTURING REDUCED IRON BRIQUETTES

BACKGROUND OF THE INVENTION

1. Field of the Invention

The present invention relates to reduced iron briquettes suitable as a stock material of a steel making furnace such as an electric arc furnace.

2. Description of the Related Art

FIG. 5 is a schematic diagram showing equipment for manufacturing reduced iron briquettes. Reduced iron briquettes are generally manufactured by the steps of: feeding reduced iron G prepared in a direct reduction furnace 1 such as a shaft furnace, a fluidized bed furnace, a rotary kiln, or a rotary hearth furnace, to a briquette machine 2 comprising caliber rolls and a breaker, the briquette machine 2 installed continuously from the reduction furnace 1; press-forming the reduced iron G into a sheet having breaking grooves at a predetermined interval; cutting the sheet at the breaking grooves using the breaker; and forming the cut pieces into reduced iron briquettes B1 having a high temperature of approximately 700° C. Subsequently, the hot reduced iron briquettes B1 are placed in a quench tank 3 to allow the reduced iron briquettes B1 to be quenched by water inside the tank 3. The quenched reduced iron briquettes B2 are then delivered outside the tank 3 by a conveyor 4.

The manufactured reduced iron briquettes B2 may be immediately shipped to a nearby steel making plant and melted in a steel making furnace. However, most commonly, the reduced iron briquettes are manufactured in countries where fuel price is low and exported to countries in need of an iron source. Accordingly, the reduced iron briquettes are stored and transported several times after being manufactured, including an export process. If the briquettes have low strength, they will suffer from cracking and lose weight due to shattered pieces and fine particles falling off from cracked edges during storage and transportation. Such falling off of fine particles during storage and transportation damages environment and adversely affects transporting vehicles, ships, equipment, and particularly the workers therein. Cracking also causes reoxidation of the reduced iron at the cracked faces, which results in a decrease in metallization and degradation of quality. Cracking, generation of fine particles, and a decrease in metallization cause operational problems such as a decrease in melt yield in steel making plants.

It has been found, as one of the causes of cracking of the reduced iron briquettes, that quenching of hot reduced iron briquettes by placing them in water causes stresses to remain inside the briquettes which generate microscopic cracks and thus makes the resulting briquettes readily breakable even when they are lightly impacted.

Based on this finding, a method for cooling hot reduced iron briquettes by which reduced iron briquettes having a superior anti-cracking property can be manufactured has been invented. This invention is disclosed in Japanese Unexamined Patent Application Publication No. 6-316718 (related art). This related art employs one cooling method selected from: (1) cooling hot reduced iron briquettes simply by spraying water; (2) slow-cooling hot reduced iron briquettes by spraying water to a temperature of 350 to 250° C. and then quenching the slow-cooled reduced iron briquettes by placing them in water; and (3) slow-cooling hot reduced iron briquettes by an inert gas or a mixture of air and 20% or more of inert gas, instead of sprayed water, to a temperature of 350 to 250° C. and then quenching the slow-cooled reduced iron briquettes by placing them in water.

Since the cooling methods (1) and (2) above use sprayed water to initially cool the hot reduced iron briquette, the surfaces of the reduced iron briquettes are rapidly cooled, resulting in degradation of the strength, although the degradation is not as extensive as when the hot reduced iron briquettes are directly immersed in water. Cooling method (3) does not suffer from degradation in strength due to rapid cooling since the briquettes are initially cooled using gas; however, method (3) requires high cost since expensive inert gas is used to manufacture the reduced iron briquettes, which is a problem.

SUMMARY OF THE INVENTION

It is an object of the present invention to provide a method for manufacturing a reduced iron briquette by which degradation in strength of the briquette caused during cooling can be prevented at low costs.

To achieve this end, the present invention provides a method for manufacturing reduced iron briquettes comprising a cooling process for cooling hot reduced iron briquettes to a temperature in a final product temperature range of not more than 120° C., the cooling process comprising: a primary cooling step of cooling the hot reduced iron briquettes by steam; a secondary cooling step of cooling the reduced iron briquettes by both steam and sprayed water; and a final cooling step of cooling the reduced iron briquettes by sprayed water to a temperature in the final product temperature range.

Preferably, the cooling rate of the hot reduced iron briquettes is 4.0° C./s or less in the primary cooling step and the secondary cooling step, and is 3.5° C./s or more in the final cooling step.

Preferably, the hot reduced iron briquettes are cooled from an initial temperature to a temperature in the final product temperature range in 1.5 to 3.0 minutes.

Preferably, the steam generated by the heat exchange between the sprayed water and the reduced iron briquettes during the final cooling step is used in at least one of the primary cooling step and the secondary cooling step.

Preferably, the hot reduced iron briquettes are prepared either by hot-forming a reduced iron material obtained by a direct reduction iron-making process using a briquette machine or by reducing briquette-shaped materials containing iron oxide.

The present invention divides the cooling process of the hot reduced iron briquettes into three steps, and different cooling media are used in each step. For example, only steam is used in one step, both steam and water is used in another step, and only water is used in yet another step. In the present invention, during the primary and secondary cooling steps, relatively moderate cooling is performed. In the final cooling step, the cooling rate is relatively high.

According to the method of the present invention, since gas, i.e., steam, having a temperature higher than water, i.e., approximately 150 to 250° C., is used instead of water during the primary cooling step, the temperature difference between the reduced iron briquettes and the steam is significantly smaller than that between the reduced iron briquettes and water. Moreover, unlike water, steam does not absorb heat by evaporation. Accordingly, the surfaces of the reduced iron briquettes are prevented from being quenched and the degradation in strength can be prevented. Furthermore, when reduced iron briquettes are cooled, they are normally stacked in layers, as described below. Since steam is a gas and can enter the gaps between layers more easily than can water, the entire surface of each reduced iron briquette can come into contact with the steam and can be uniformly cooled. Since steam is less expensive than inert gas, the cost required in the method of the present invention is lower compared with method (3) described above where a substantial amount of inert gas is required. Steam has a low oxidizing power compared with air and by itself has substantially the same oxidizing power compared to that of a mixture of air and 20% inert gas. Thus, steam rarely reoxidizes the reduced iron briquettes.

As the reduced iron briquettes are cooled, the temperature difference between the reduced iron briquettes and the stem becomes smaller, thereby decreasing the cooling rate. Accordingly, in the next cooling step, i.e., the secondary cooling step, both steam and sprayed water is used to increase the cooling rate to an extent which does not degrade the strength of the reduced iron briquettes, and to shorten the cooling time.

In the final cooling step, the problem of strength degradation does not occur even when the reduced iron briquettes are cooled at a relatively high cooling rate. Thus, only sprayed water is used to shorten the cooling time.

During the primary and secondary cooling steps, the cooling rate of the reduced iron briquettes is preferably 4.0° C./s or less, more preferably, 3.5° C./s or less, and most preferably, 3.0° C./s or less so as to prevent degradation of the strength. During the final cooling step, the cooling rate is preferably 3.5° C./s or more, more preferably, 4.5° C./s or more, and most preferably, 5.5° C./s or more so as to shorten the cooling time. The cooling rate is controlled by suitably adjusting the temperature and the flow of the steam and/or sprayed water in each of the cooling steps. Since the controllable range of the temperature of the steam and sprayed water is limited, the flow is mainly adjusted to achieve optimum cooling rates.

Preferably, the time required to cool the reduced iron briquette from the initial temperature to a temperature in the final product temperature range, i.e., the cooling time, is 1.5 to 3.0 minutes. A cooling time or less than 1.5 minutes may degrade the strength of the reduced iron briquettes because the cooling rate is excessively high. A cooling time exceeding 3.0 minutes may reoxidize the reduced iron briquettes and decrease the productivity. The cooling time can be adjusted to be within the above-described range by suitably coordinating the cooling rate of each of the cooling steps within the above-described preferable range.

The sprayed water used in the final cooling step exchanges heat with the reduced iron briquettes, evaporates, and becomes steam. This steam may be retrieved and used in the primary and/or secondary cooling step to reduce the amount of steam used in the cooling process. When a sufficiently large amount of steam is retrieved, introduction of steam from an external source such as an additional plant is unnecessary, thereby saving the cost of installing new apparatuses such as a steam generator. Thus, the cost can be further reduced. If the amount of the steam is excessive, the steam may be supplied to other plants.

The hot reduced iron briquettes are not limited to those manufactured by hot-forming reduced iron prepared by a direct reduction furnace using a briquette machine. The hot reduced iron briquettes may be obtained by reducing briquette-shaped material containing iron oxide. For example, the hot reduced iron briquettes may be prepared by: mixing an iron-oxide containing material, an adequate amount of carbonaceous material, and a small amount of binder, if necessary, to prepare a mixture; cold-forming the mixture using a briquette machine into briquettes; and reducing the resulting briquettes by heating in a rotary hearth furnace. It should be noted that the reduced iron prepared by reducing the material iron at a relatively low temperature of 700 to 900° C. in a shaft furnace or a fluidized bed furnace has a large number of micro pores therein. Thus, when this reduced iron is cooled using steam or water without having to undergo hot forming, a problem of severe oxidation occurs during cooling. In contrast, because the rotary hearth furnace generally heats the iron at a high temperature of approximately 1,200° C. or more, the reduced iron particles are sintered, thereby decreasing number of micro pores and preventing the problem of severe reoxidation.

According to the method for manufacturing reduced iron briquettes of the present invention, the hot reduced iron briquettes can be cooled at low cost, and the manufactured reduced iron briquettes suffer less from cracking during storage and transportation, generate less fine particles due to cracking, and have superior metallization. Adverse affects on transporting vehicles, ships, equipment, and particularly the workers therein caused by falling off of the fine particles during storage and transportation of the reduced iron briquettes can be prevented. Moreover, reoxidation of the reduced iron at the cracked faces can be less since cracking is minimized. Thus, high-quality reduced iron briquettes can be stably manufactured.

DESCRIPTION OF THE PREFERRED EMBODIMENTS

The preferred embodiments of the present invention are now described with reference to the drawings.

Figure 1:
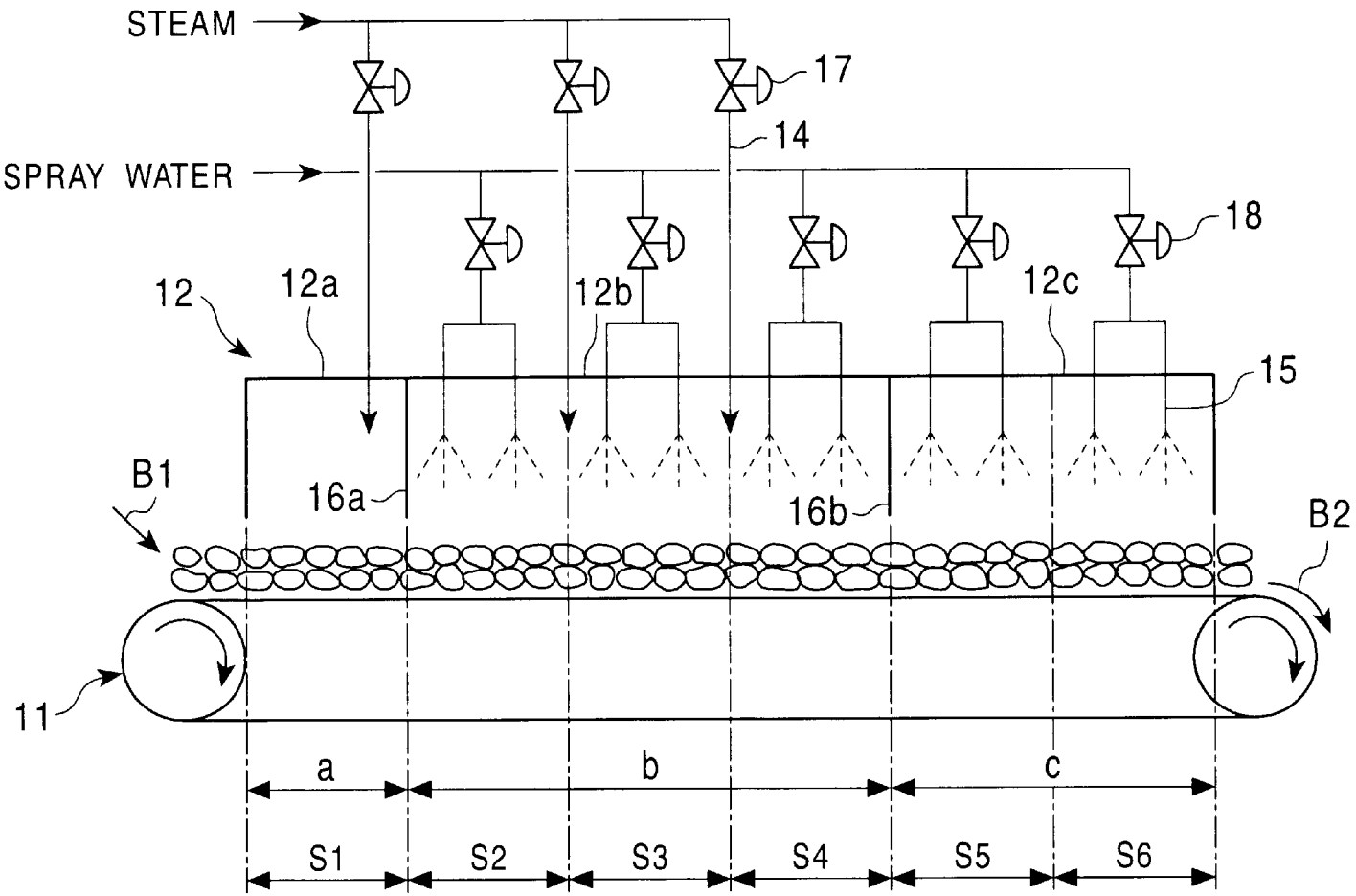
FIG. 1 is a schematic diagram for explaining an embodiment of equipment incorporating a method for manufacturing reduced iron briquettes according to the present invention.

FIG. 1 is a schematic diagram for explaining an embodiment of equipment, i.e., a cooling unit, incorporating a method for manufacturing reduced iron briquettes according to the present invention. As shown in FIG. 1, the cooling unit comprises an endlessly rotating conveyor 11, hereinafter simply "the conveyor 11", and a hood 12 that covers the conveyor 11 from above. The hood 12 is divided into three zones in the longitudinal direction by partitions 16*a* and 16*b*. The three zones are, in order of the traveling direction of the conveyor 11, an initial zone a (first cooling step), an intermediate zone b (second cooling step), and a final zone c (third cooling step). The length of each zone in the longitudinal direction can be suitably adjusted to efficiently perform cooling. For example, as shown in FIG. 1, the ratio of the initial zone to the intermediate zone to the final zone is adjusted at 1:3:2. The initial zone a (first cooling step) is covered with a hood 12*a*. Only a steam nozzle 14 is installed at the upper side of the interior of the hood 12*a*. The intermediate zone b (second cooling step) is covered with a hood 12*b*. The steam nozzles 14 and water spraying nozzles 15 are installed at the upper side of the interior of the hood 12*b*. The final zone c (third cooling step) is covered with a hood 12*c*. Only the water spraying nozzles 15 are installed at the upper side of the interior of the hood 12*c*.

In operation, for example, hot reduced iron briquettes B1 of approximately 700° C. immediately after hot-forming using a briquette machine (not shown) are allowed to fall inside a cooling chute (not shown) provided with an inert gas feeding duct, the cooling chute being installed continuously from the briquette machine. The briquettes are cooled to a temperature of approximately 530 to 560° C. by falling and placed on the conveyor 11. The hot reduced iron briquettes B1 are ideally placed on the conveyor 11 in one layer so as not to overlap one another for the purpose of efficient cooling, but to some extent, overlapping is inevitable in actual operation. Moreover, for the purpose of size reduction of the cooling equipment, the briquettes are often intentionally placed in plural layers.

The hot reduced iron briquettes B1 held on the conveyor 11 first travel through the initial zone a during which the hot reduced iron briquettes B1 are slow-cooled by the steam fed from the steam nozzle 14. Since steam is a gas, the steam can enter the gap between the layers of the hot reduced iron briquettes B1 described above and the entire surface of each of the hot reduced iron briquettes B1 comes into contact with the steam, thereby achieving uniform cooling even when the hot reduced iron briquettes B1 are stacked in layers. No limit is imposed as to the height at which the steam nozzle 14 is installed. In order to efficiently cool the hot reduced iron briquettes B1, the steam nozzle 14 is preferably installed at a height such that the steam can be directly supplied onto the surfaces of the hot reduced iron briquettes B1. The number of the steam nozzle 14 may be selected to suit the width and the length of the initial zone a. In order to generate a counterflow steam in the hood 12*a* which achieves most efficient cooling, the steam nozzle 14 is preferably installed in the vicinity of the delivery of the initial zone a. Some of the steam from the steam nozzle 14 in the vicinity of the delivery of the initial zone 1 may leak into the intermediate zone b through the gap under the partition 16*b* disposed between the initial zone a and the intermediate zone b. However, this does not cause a problem since the steam is required also in the intermediate zone b. The interior of the initial zone a is always charged with steam and maintained at a positive pressure so as to prevent intrusion of air from outside and reoxidation of the reduced iron briquettes. The flow of the steam is adjusted by a flow control valve 17 installed at the upstream of the steam nozzle 14. By suitably adjusting the flow of the steam, preferably, the hot reduced iron briquettes B1 are cooled at a relatively moderate cooling rate of 4.0° C./s or less, more preferably, 3.5° C./s or less, and most preferably, 3.0° C./s or less, to a temperature in the range of 480 to 530° C.

Next, the reduced iron briquettes B1 held on the conveyor 11 are transferred to the intermediate zone b. When the intermediate zone b has a large length in the longitudinal direction as in this embodiment, the steam nozzles 14 are preferably provided at plural locations in the longitudinal direction and the flow of each steam nozzle 14 is preferably individually controlled so as to suitably control the cooling rate. As in the initial zone a, the steam nozzles 14 are preferably installed in the vicinity of the delivery of the intermediate zone b to achieve counterflow steam. However, when the steam nozzle 14 is installed directly near the delivery of the intermediate zone b, some of the steam may leak into the final zone c through apertures in the partition 16*b*, thereby decreasing the cooling rate of the reduced iron briquettes B1 in the final zone c. Thus, the steam nozzles 14 are preferably installed in the region other than the region directly near the delivery of the intermediate zone b. The water spraying nozzles 15 are preferably installed at plural locations in the longitudinal direction so that the cooling rate of the reduced iron briquettes B1 can be finely controlled. The flow of each steam nozzle 14 is individually controlled by the corresponding flow control valve 17 installed at the upstream of the steam nozzle 14. The flow of each water spraying nozzle 15 is individually controlled by a flow control valve 18 installed at the upstream of the water spraying nozzle 15. The reduced iron briquettes B1 are preferably cooled at a relatively moderate cooling rate of 4.0° C./s or less, more preferably, 3.5° C./s or less, and most preferably, 3.0° C./s or less, to a temperature in the range of 300 to 360° C. by controlling the flows of the steam nozzles 14 and the water spraying nozzles 15 using the flow control valves 17 and the flow control valves 18.

The reduced iron briquettes B1 held on the conveyor 11 are then transferred to the final zone c and cooled to a temperature in a final product temperature range, i.e., 120° C. or less, only by spraying water from the water spraying nozzles 15. In the final zone c, a plurality of the water spraying nozzles 15 located at plural locations in the longitudinal direction is preferably provided to rapidly and uniformly cool the reduced iron briquettes B1. In the final zone c, no steam is used. However, since the sprayed water evaporates by the sensible heat of the reduced iron briquettes, the interior of the hood 12*c* is filled with steam and maintains a positive pressure. Thus, air is prevented from entering and reoxidation of the reduced iron briquettes B1 can be prevented. The reduced iron briquettes B1 are preferably cooled at a relatively high cooling rate of 3.5° C./s or more, more preferably, 4.5° C./s or more, and most preferably, 5.5° C./s or more using the flow control valve 18 installed at the upstream of the water spraying nozzles 15.

The cooling rate in each of the above cooling steps may be suitably coordinated within the above ranges so that the time required for cooling the briquettes at an initial temperature to a temperature in the final product temperature range is in the range of 1.5 to 3.0 minutes.

Figure 2:
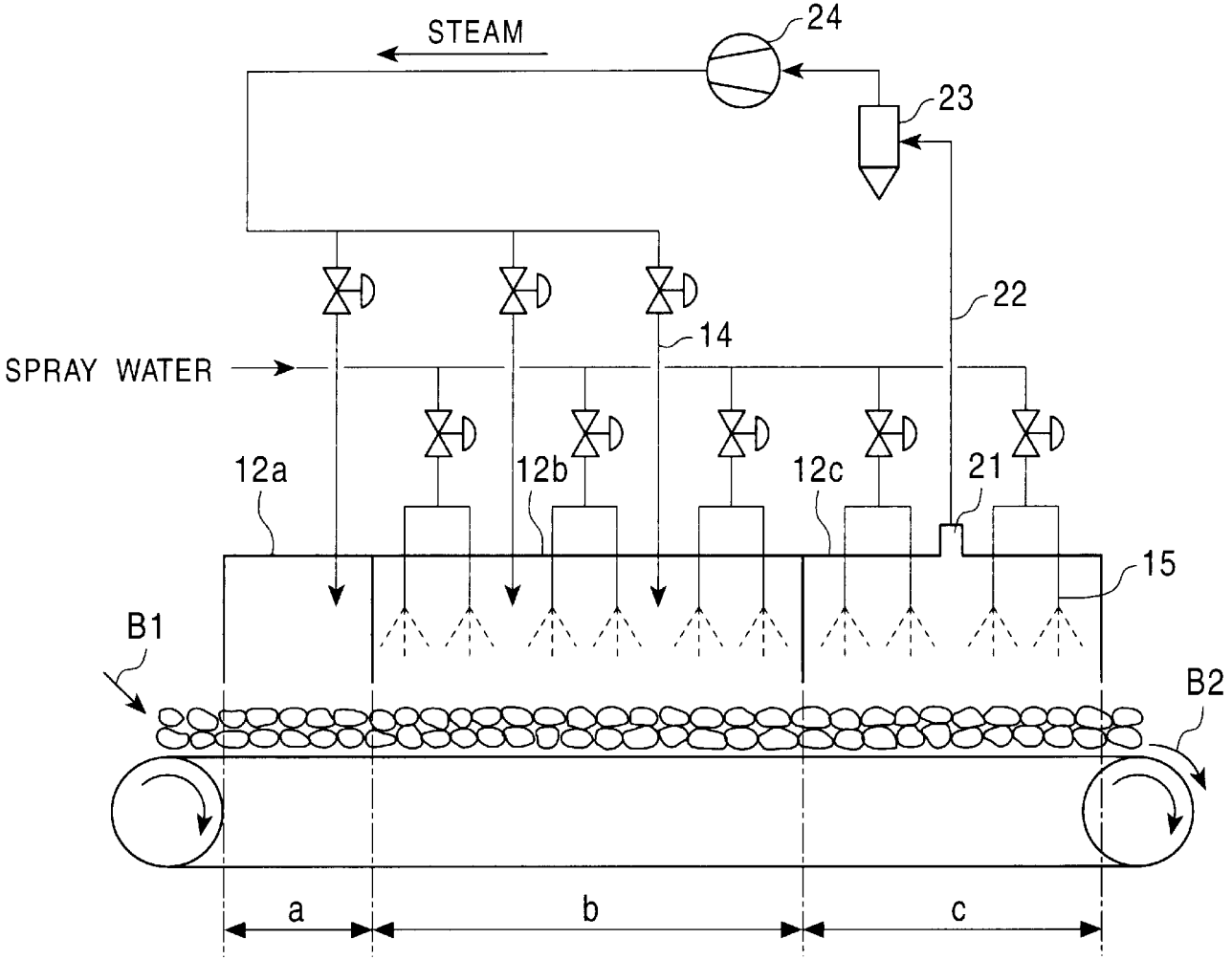
FIG. 2 is a schematic diagram for explaining another embodiment of equipment incorporating the method for manufacturing reduced iron briquettes according to the present invention.

FIG. 2 is a schematic diagram for explaining another embodiment of equipment, i.e., a cooling unit, incorporating a method for manufacturing reduced iron briquettes according to the present invention.

The cooling unit shown in FIG. 2 has additional equipment for retrieving the steam compared to the cooling unit shown in FIG. 1. In particular, a steam outlet 21 is provided in the hood 12*c* of the final zone c. A steam retrieving duct 22 is connected to the steam outlet 21. A dust collector 23 such as cyclone and a pressurizer 24 are connected in series at the downstream of the steam retrieving duct 22. The steam nozzles 14 in the initial zone a and the intermediate zone b are also connected to the dust collector 23 and the pressurizer 24. The steam generated by the evaporation of the sprayed water in the final zone c is evacuated from the steam outlet 21, travels through the steam retrieving duct 22, reaches the dust collector 23 where dust or the like is collected, is pressurized by the pressurizer 24 to a pressure required for injection, and is injected to the initial zone a and/or the intermediate zone b via the steam nozzles 14. In this manner, the amount of steam introduced from outside can be reduced. If the amount of the retrieved steam is sufficiently large, introduction of steam from outside may be completely unnecessary. Preferably, steam outlets (not shown) identical to the steam outlet 21, and ducts (not shown) which converge into the steam retrieving duct 22 may be provided in the hood 12*a* of the initial zone a and/or the hood 12*b* of the intermediate zone b. In this manner, excess steam in the initial zone a and/or the intermediate zone b can be retrieved to increase the amount of the retrieved steam, thereby making the introduction of steam from an external source completely unnecessary even when the amount of retrieved steam from the final zone c is small.

Although the cooling unit of the above embodiment is of an endlessly rotating conveyor type, the cooling unit can be of any type as long as the effects and the advantages of the present invention are achieved. For example, the cooling unit may be of an annular cooler type in which annular pallets rotate horizontally.

Alternatively, the conveyor or the pallets may be of a mesh type so that the steam fed from below the conveyor or the pallets can reach the work through the conveyor or the pallets. The steam is preferably supplied from both above and below the conveyor or the pallets so that the steam can be evenly distributed to the gaps between the layers of the reduced iron briquettes, thereby improving the cooling efficiency. When the conveyor or the pallets are of a mesh type, a blast box connected to a suction blower may be provided to retrieve the generated steam from below.

EXAMPLES

Experiments were conducted using the cooling unit for cooling the reduced iron briquettes shown in FIG. 1 under various cooling conditions to confirm the effects of the present invention.

The cooling conditions are shown in Table 1. For the purpose of the experiment, the entirety of the cooling zone, which is the region covered by the hood 12, shown in FIG. 1 is divided equally into six sections in the longitudinal direction and each section is numbered from 1 to 6 from the section closest to the entry of the hot reduced iron briquettes B1. In Table 1, the six sections are referred to as section 1 to section 6, and as S1 to S6 in FIG. 1. Section 1 corresponds to the initial zone a, sections 2 to 4 correspond to the intermediate zone b, and the sections 5 and 6 correspond to the final zone c.

Sample methods 4 to 8 incorporated the present invention (Example) and used both steam and sprayed water as a cooling medium. In the initial zone, i.e., section 1, only steam was used. In the intermediate zone, i.e., sections 2 to 4, both steam and sprayed water were used. In the final zone, i.e., sections 5 and 6, only sprayed water was used. Sample methods 1 to 3 were comparative examples incorporating a known art, i.e., cooling method (1) described in the related art section. In the comparative examples, only sprayed water was used.

Medium pressure steam having a temperature of 200° C. was used as cooling steam. In the sample methods 4 to 7, a retrieved condensate of 60 to 80° C. was used. In the sample methods 1 to 3, industrial water of 30 to 35° C. was used.

TABLE 1

| Sample methods | | Initial zone | Intermediate zone | | | Final zone | | Ref. |
|---|---|---|---|---|---|---|---|---|
| | | Section 1 | Section 2 | Section 3 | Section 4 | Section 5 | Section 6 | |
| 1 | Sprayed water ($m^3$/t-B) | 0.125 | 0.125 | 0.187 | 0.187 | 0.375 | 0 | Comparative Example |
| 2 | Sprayed water ($m^3$/t-B) | 0 | 0.125 | 0.125 | 0.125 | 0.25 | 0.375 | |
| 3 | Sprayed water ($m^3$/t-B) | 0 | 0.125 | 0.187 | 0.187 | 0.375 | 0 | |
| 4 | Steam (valve opening %) | 50 | 50 | 100 | — | — | — | Invention Example |
| | Sprayed water ($m^3$/t-B) | 0 | 0.12 | 0.177 | 0.177 | 0.296 | 0.355 | |
| 5 | Steam (valve opening %) | 100 | 100 | 100 | — | — | — | |
| | Sprayed water ($m^3$/t-B) | 0 | 0.12 | 0.177 | 0.177 | 0.296 | 0.296 | |
| 6 | Steam (valve opening %) | 50 | 100 | 100 | — | — | — | |
| | Sprayed water ($m^3$/t-B) | 0 | 0.066 | 0.133 | 0.2 | 0.396 | 0 | |
| 7 | Steam (valve opening %) | 100 | 100 | 100 | — | — | — | |
| | Sprayed water ($m^3$/t-B) | 0 | 0.056 | 0.112 | 0.112 | 0.396 | 0.224 | |
| 8 | Steam (valve | 50 | 50 | 0 | — | — | — | |

TABLE 1-continued

| Sample methods | Initial zone | Intermediate zone | | | Final zone | | Ref. |
|---|---|---|---|---|---|---|---|
| | Section 1 | Section 2 | Section 3 | Section 4 | Section 5 | Section 6 | |
| opening %) Sprayed water ($m^3$/t-B) | 0 | 0 | 0.169 | 0.169 | 0.281 | 0.281 | |

Figure 3:
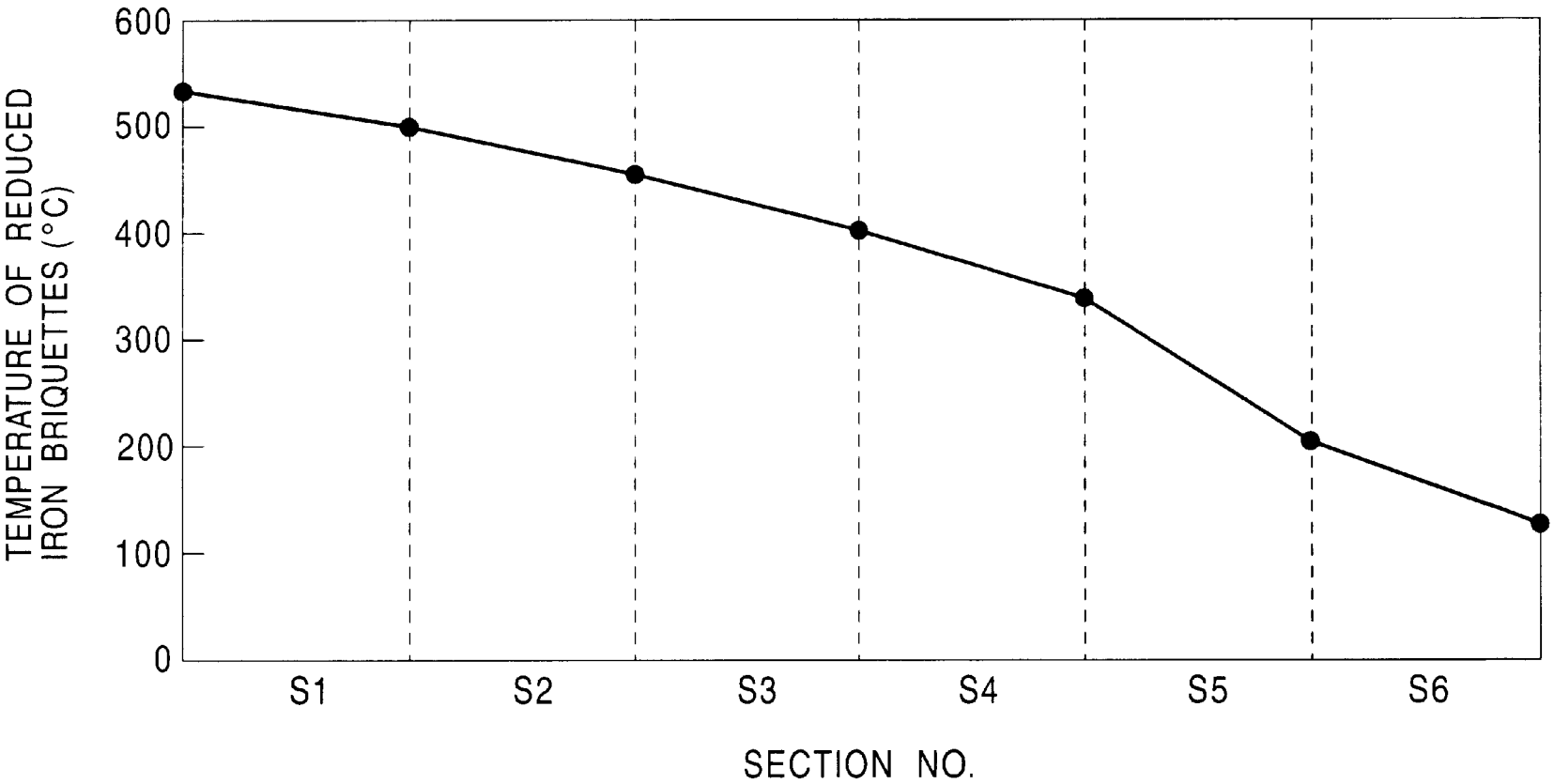
FIG. 3 is a graph showing temperature changes of the reduced iron briquettes in a cooling unit of an invention example.

The temperature of the reduced iron briquettes was measured at each of the section borders in sample method 4. The results are shown in FIG. 3. As shown in FIG. 3, hot reduced iron briquettes at a temperature of approximately 530° C. were fed to the cooling unit, cooled at a relatively moderate cooling rate of approximately 1.5 to 3.3° C./s in the initial and intermediate zones, i.e., sections 1 to 4, and then cooled at a relatively high cooling rate of approximately 4.0 to 6.8° C./s in the final zone, i.e., sections 5 and 6, to a temperature of approximately 120° C. The time taken for the reduced iron briquettes to pass through the cooling unit and to be cooled to a temperature of approximately 120° C. was approximately 2.0 minutes. The temperature of the reduced iron briquettes was not measured during experiments of other sample methods, but the reduced iron briquettes passed through the cooling unit in 1.5 to 3.0 minutes and were cooled to approximately 100 to 120° C. in each method.

Next, the strength and the metallization of the reduced iron briquettes cooled under the cooling conditions described in Table 1 were measured. The strength was measured by shatter strength testing. In the shatter strength testing, an appropriate number of reduced iron briquettes were placed in an iron container, and the iron container was dropped 5 times from a height of 10 m. Subsequently, the content of the iron container was sifted using a 38.1-mm-mesh screen, and the percentage by mass of the remainder blocks on the screen was determined to evaluate the anti-cracking property.

Figure 4:
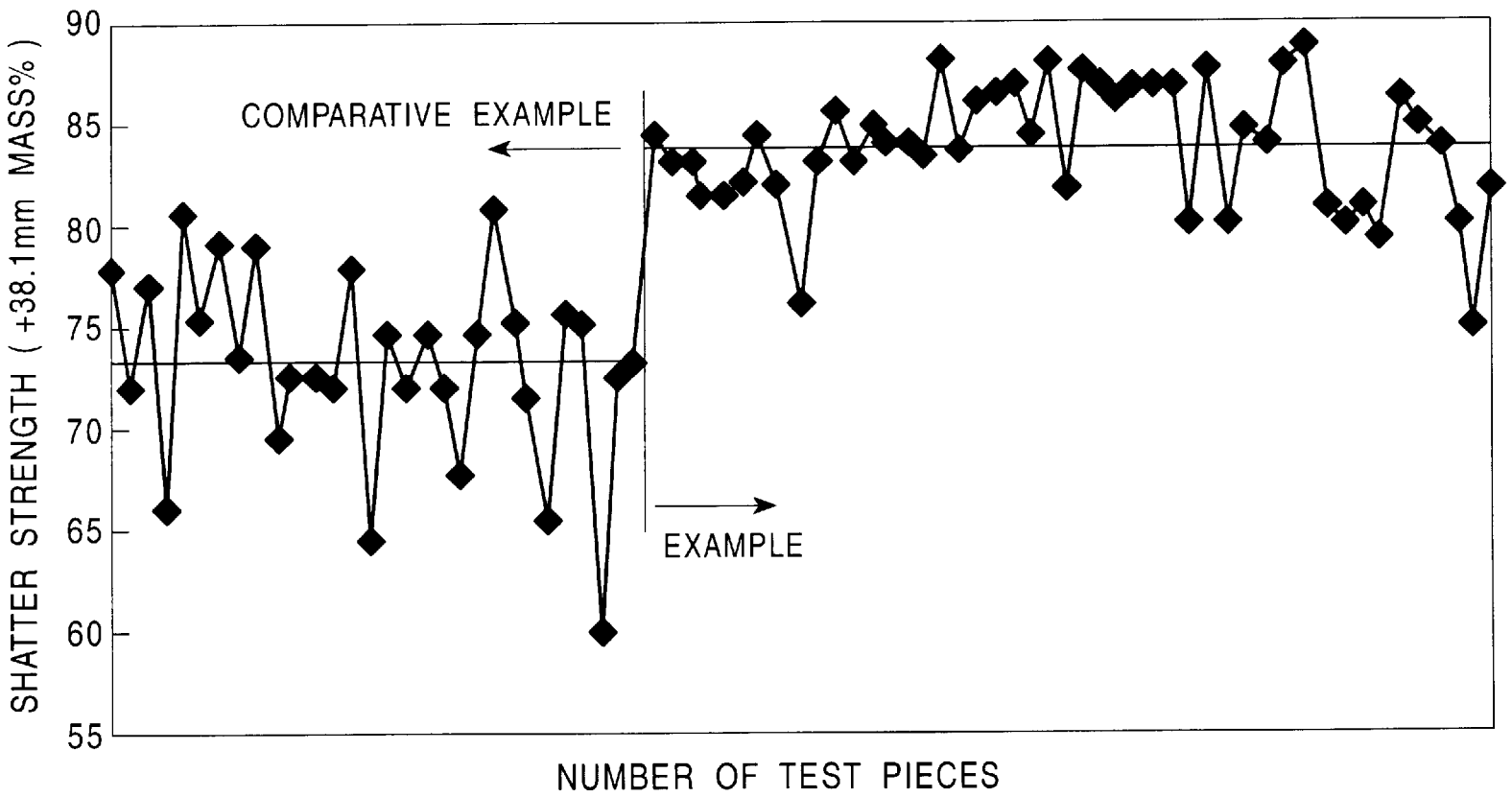
FIG. 4 is a graph showing the results of shatter strength testing for comparing the reduced iron briquettes of the invention example and a comparative example.
Figure 5:
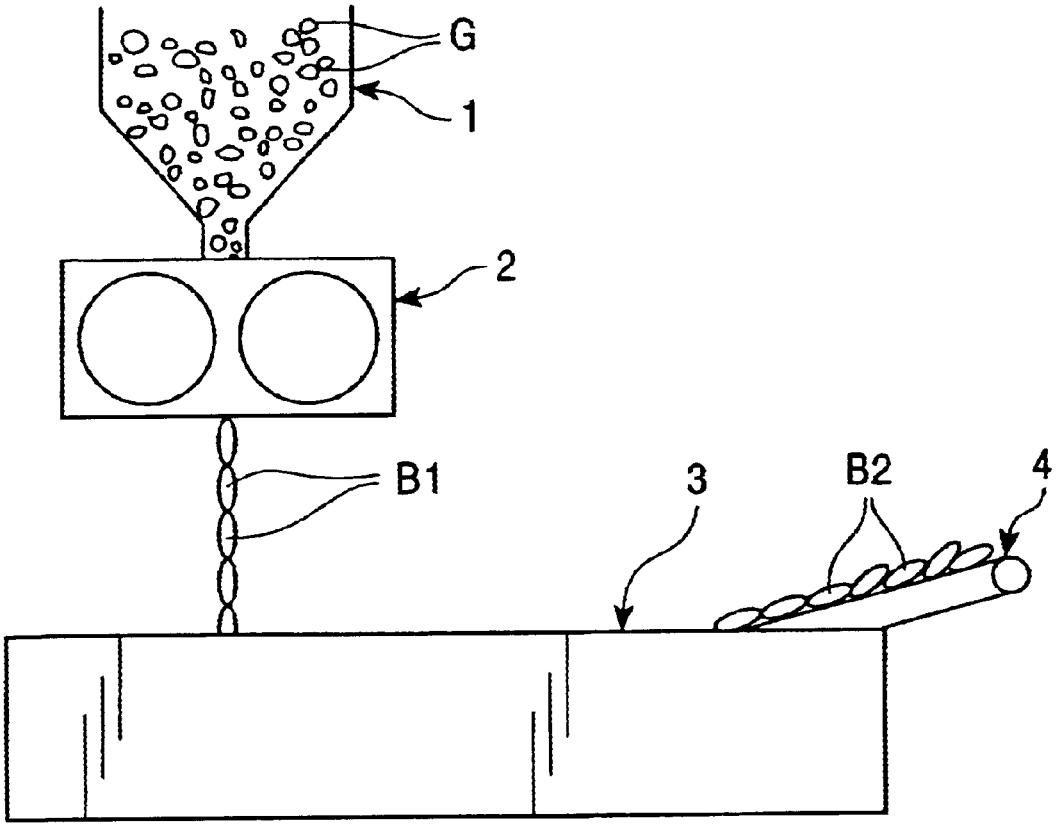
FIG. 5 PRIOR ART
FIG. 5 is a schematic diagram of equipment for manufacturing reduced iron briquettes according to a related art.

The results of the shattered strength test are shown in FIG. 4. In the reduced iron briquettes of the comparative example, the average percentage of blocks larger than 38.1 mm remaining on the screen was approximately 73%. In the reduced iron briquettes of the invention example, the average percentage was approximately 84%, which is significantly higher than that of the comparative example. The metallization of the reduced iron briquettes after processing using the cooling unit was compared to that before the processing. In the invention example, a decrease of 0.5% or less was observed after the processing, which is approximately the same as that of the comparative example. The results demonstrate that the reduced iron briquettes manufactured by the invention method are more resistant to cracking, generate less fine particles, and do not undergo an extensive decrease in the metallization.

What is claimed is:

1. A method for manufacturing reduced iron briquettes, the method comprising a cooling process for cooling hot reduced iron briquettes to a temperature in a final product temperature range of not more than 120° C., the cooling process comprising:

a primary cooling step of cooling the hot reduced iron briquettes by steam;

a secondary cooling step of cooling the reduced iron briquettes by both steam and sprayed water; and a final cooling step of cooling the reduced iron briquettes by sprayed water to a temperature in the final product temperature range.

2. A method for manufacturing reduced iron briquettes according to claim 1, wherein the cooling rate of the hot reduced iron briquettes is 4.0° C./s or less in the primary cooling step and the secondary cooling step, and is 3.5° C./s or more in the final cooling step.

3. A method for manufacturing reduced iron briquettes according to claim 2, wherein the hot reduced iron briquettes are cooled from an initial temperature to a temperature in the final product temperature range in 1.5 to 3.0 minutes.

4. A method for manufacturing reduced iron briquettes according to claim 1, wherein steam is generated by the heat exchange between the sprayed water and the reduced iron briquettes during the final cooling step, and the generated steam is used in at least one of the primary cooling step and the secondary cooling step.

5. A method for manufacturing reduced iron briquettes according to claim 3, wherein steam is generated by the heat exchange between the sprayed water and the reduced iron briquettes during the final cooling step, and the generated steam is used in at least one of the primary cooling step and the secondary cooling step.

6. A method for manufacturing reduced iron briquettes according to claim 1, wherein the hot reduced iron briquettes are prepared either by hot-forming a reduced iron material obtained by a direct reduction iron-making process using a briquette machine or by reducing briquette-shaped materials containing iron oxide.

7. A method for manufacturing reduced iron briquettes according to claim 3, wherein the hot reduced iron briquettes are prepared either by hot-forming a reduced iron material obtained by a direct reduction iron-making process using a briquette machine or by reducing briquette-shaped materials containing iron oxide.

* * * * *